US008866801B2

(12) United States Patent
Yen

(10) Patent No.: US 8,866,801 B2
(45) Date of Patent: Oct. 21, 2014

(54) DEVICE WITH AUTOMATIC DE-SKEW CAPABILITY

(75) Inventor: Yu Jen Yen, Tainan (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 179 days.

(21) Appl. No.: 13/563,131

(22) Filed: Jul. 31, 2012

(65) Prior Publication Data

US 2013/0038582 A1 Feb. 14, 2013

(30) Foreign Application Priority Data

Aug. 9, 2011 (TW) ..... 100128299 A

(51) Int. Cl.

| | |
|---|---|
| ***G09G 5/00*** | (2006.01) |
| ***G09G 5/37*** | (2006.01) |
| ***G09G 3/20*** | (2006.01) |

(52) U.S. Cl.

CPC ..... *G09G 3/2096* (2013.01); *G09G 5/37* (2013.01)

USPC ..... 345/204

(58) Field of Classification Search

USPC ..... 345/99, 204, 691

See application file for complete search history.

(56) References Cited

U.S. PATENT DOCUMENTS 8,111,233 B2 * 2/2012 Arai ..... 345/99

* cited by examiner

*Primary Examiner* — Yong H Sim

(57) ABSTRACT

The present invention discloses a device with an automatic de-skew capability, comprising a data signal delay module, a plurality of data registers, and a delay data signal selection module. The present device outputs an optimal delay data signal and a clock signal to a source driver to drive a display panel.

5 Claims, 6 Drawing Sheets

| R1 | R2 | R3 | R4 | R5 | First success sample signal | Last success sample signal | the best sample signal |
|---|---|---|---|---|---|---|---|
| 0 | 1 | 0 | 0 | 0 | 0 | 7 | 0 |
| 0 | 1 | 0 | 0 | 1 | 0 | 8 | 1 |
| 0 | 1 | 0 | 1 | 0 | 0 | 9 | 2 |
| 0 | 1 | 0 | 1 | 1 | 0 | 10 | 3 |
| 0 | 1 | 1 | 0 | 0 | 0 | 11 | 4 |
| 0 | 1 | 1 | 0 | 1 | 0 | 12 | 5 |
| 0 | 1 | 1 | 1 | 0 | 0 | 13 | 6 |
| 0 | 1 | 1 | 1 | 1 | 0 | 14 | 7 |
| 1 | 1 | 0 | 0 | 0 | 7 | 15 | 15 |
| 1 | 1 | 0 | 0 | 1 | 6 | 15 | 14 |
| 1 | 1 | 0 | 1 | 0 | 5 | 15 | 13 |
| 1 | 1 | 0 | 1 | 1 | 4 | 15 | 12 |
| 1 | 1 | 1 | 0 | 0 | 3 | 15 | 11 |
| 1 | 1 | 1 | 0 | 1 | 2 | 15 | 10 |
| 1 | 1 | 1 | 1 | 0 | 1 | 15 | 9 |
| 1 | 1 | 1 | 1 | 1 | 0 | 15 | 8 |

| D1 | D2 | D3 | D4 |
|---|---|---|---|
| 0 | 0 | 0 | 0 |
| 0 | 0 | 0 | 1 |
| 0 | 0 | 1 | 0 |
| 0 | 0 | 1 | 1 |
| 0 | 1 | 0 | 0 |
| 0 | 1 | 0 | 1 |
| 0 | 1 | 1 | 0 |
| 0 | 1 | 1 | 1 |
| 1 | 1 | 1 | 1 |
| 1 | 1 | 1 | 0 |
| 1 | 1 | 0 | 1 |
| 1 | 1 | 0 | 0 |
| 1 | 0 | 1 | 1 |
| 1 | 0 | 1 | 0 |
| 1 | 0 | 0 | 1 |
| 1 | 0 | 0 | 0 |

FIG. 6

DEVICE WITH AUTOMATIC DE-SKEW CAPABILITY

BACKGROUND

1. Technical Field

The present invention relates to a source driving device and, in particular, to a source driving device with automatic de-skew capability.

2. Description of Related Arts

Due to rapid developments in technology, the LCD is now applied in a wide range of electronic devices such as mobile phones, PCs, laptops, and flat-screen TVs. A timing controller of a LCD is usually utilized for generating data signals, related to imaging displays, control signals and clock signals for driving the LCD panel. The source driving device of the LCD executes logic calculations based on data signals, clock signals and control signals to generate driving signals for the LCD panel.

The transmission interfaces, including TTL (Transistor-Transistor Logic), LVDS (Low-Voltage Differential Signaling), RSDS (Reduced Swing Differential Signaling) and mini-LVDS (Mini Low-Voltage Differential Signaling), are widely applied on the current LCD. However, it is necessary for data signals, control signals and clock signals to work together in harmony whether transmitting signals via any of interfaces, so that the internal logic circuit of the source driving device may correctly read data for generating correct driving signals.

Resulting from the development of large scale LCDs, users have a high demand for resolution quality and as such, the size of the LCD panel, quantity of the source driving devices and size of the data transmitting interfaces are also increased, such as PCBs. Therefore, signal transmitting paths between the timing controller and the source driving device of large scale LCDs become longer, so that the signal transmitting time also becomes longer. Moreover, since the circuit layouts between the timing controller and different source driving devices are different from each other, the distance of the signal transmitting paths between the timing controller and different source driving devices are also different. Due to every driving device having a different toggle rate, ground shielding and driving capability during the output stage, different source driving devices may receive signals with different delays. Consequently, the phase difference of is the signals may deviate from a predetermined deviation so that the internal circuit of the source driving device cannot correctly read data. The signal skew may greatly affect the display quality of the LCD, especially in high frequency applications.

In conventional LCDs, the phase relationship between data signals and clock signals, generated by the timing controller, are fixed. The set-up time and hold time are also fixed. Due to different source driving devices include differences in the distance of signal transmitting paths, toggle rates, ground shielding and driving capability during the output stage, the data signals and clock signals, with different delays, are received by the source driving device. As a result, the conventional LCD may lack the ability to automatically de-skew, such that the LCD may have an inferior display quality.

Therefore, the present invention provides a device with an automatic de-skew capability.

SUMMARY

In accordance with one embodiment of the present invention, a device with an automatic de-skew capability, coupled between a source driving device and a timing controller, is used for receiving a data signal and a clock signal from the timing controller for driving a display panel, comprises a data signal delay module, a plurality of to data registers, a decoding module, and a delay signal selecting module.

The data signal delay module is used for receiving the data signal and generating a plurality of data delay signals, wherein each of the plurality of data delay signals has different phases.

The plurality of data registers has a clock signal receiving terminal coupled to the data signal delay module, wherein the plurality of data delay signals are used for sampling the clock signal and wherein the plurality of data registers generates a logic value based on a sampling result.

The decoding module is coupled to an output terminal of the plurality of data registers used for generating a set of selecting signals. The delay signal selecting module is coupled to an output terminal of the data signal delay module and outputs a best sampling signal, based on the set of selecting signals, to the source driving device, wherein the sampling result includes a success sampling result and a failure sampling result.

In order to provide further understanding of the techniques, means, and effects of the current disclosure, the following detailed description and drawings are hereby presented, such that the purposes, features and aspects of the current disclosure may be thoroughly and concretely appreciated; however, the drawings are provided solely for reference and illustration, without any intention to be used for limiting the current disclosure.

BRIEF DESCRIPTION OF THE DRAWINGS

A more complete understanding of the present disclosure may be derived by referring to the detailed description and claims when considered in connection with the Figures, where like reference is numbers refer to similar elements throughout the Figures, and:

FIG. 6 shows a true table of one embodiment of the present invention.

DETAILED DESCRIPTION

In order to correct the display quality of a conventional LCD due to the disability to de-skew, the present invention discloses a device with an automatic de-skew capability.

Figure 1:
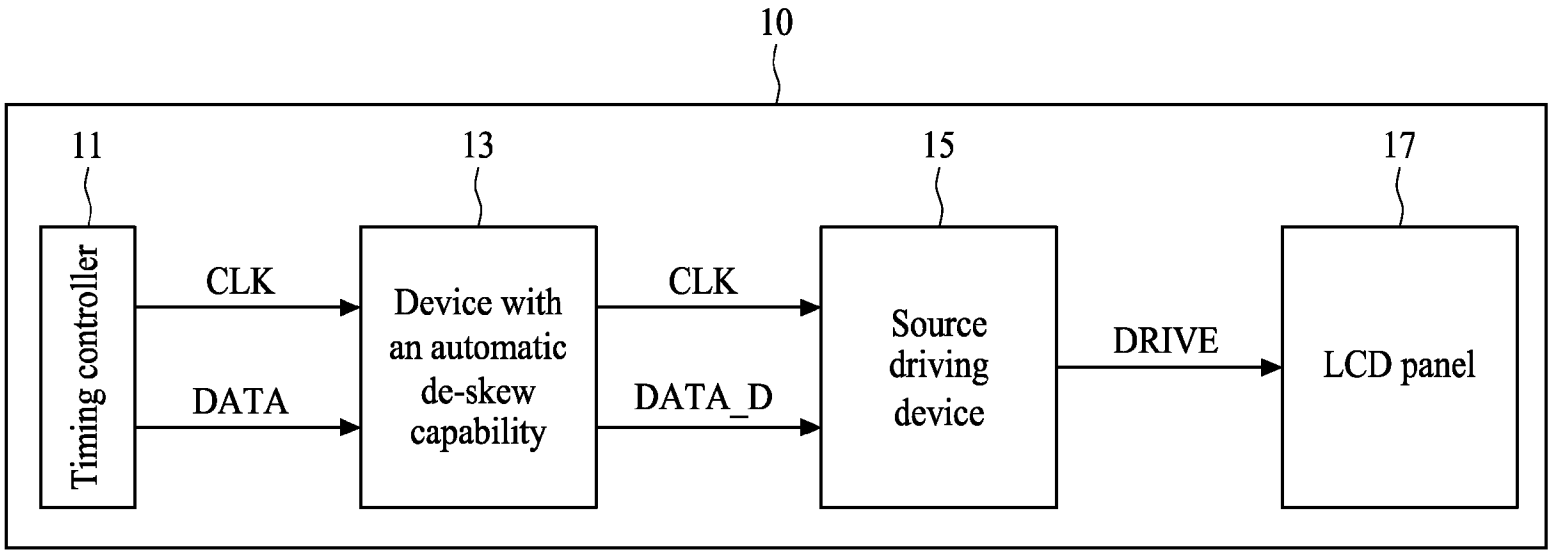
FIG. 1 shows a device with an automatic de-skew capability of one embodiment of the present invention.

FIG. 1 shows a device with an automatic de-skew capability of one embodiment of the present invention, which is in a function block of a LCD display 10. A device with an automatic de-skew capability 13, coupled between a source driving device 15 and a timing controller 11, is configured to receive a data signal (DATA) and a clock signal (CLK), from the timing controller 11, which are used for driving a LCD panel 17.

Figure 2:
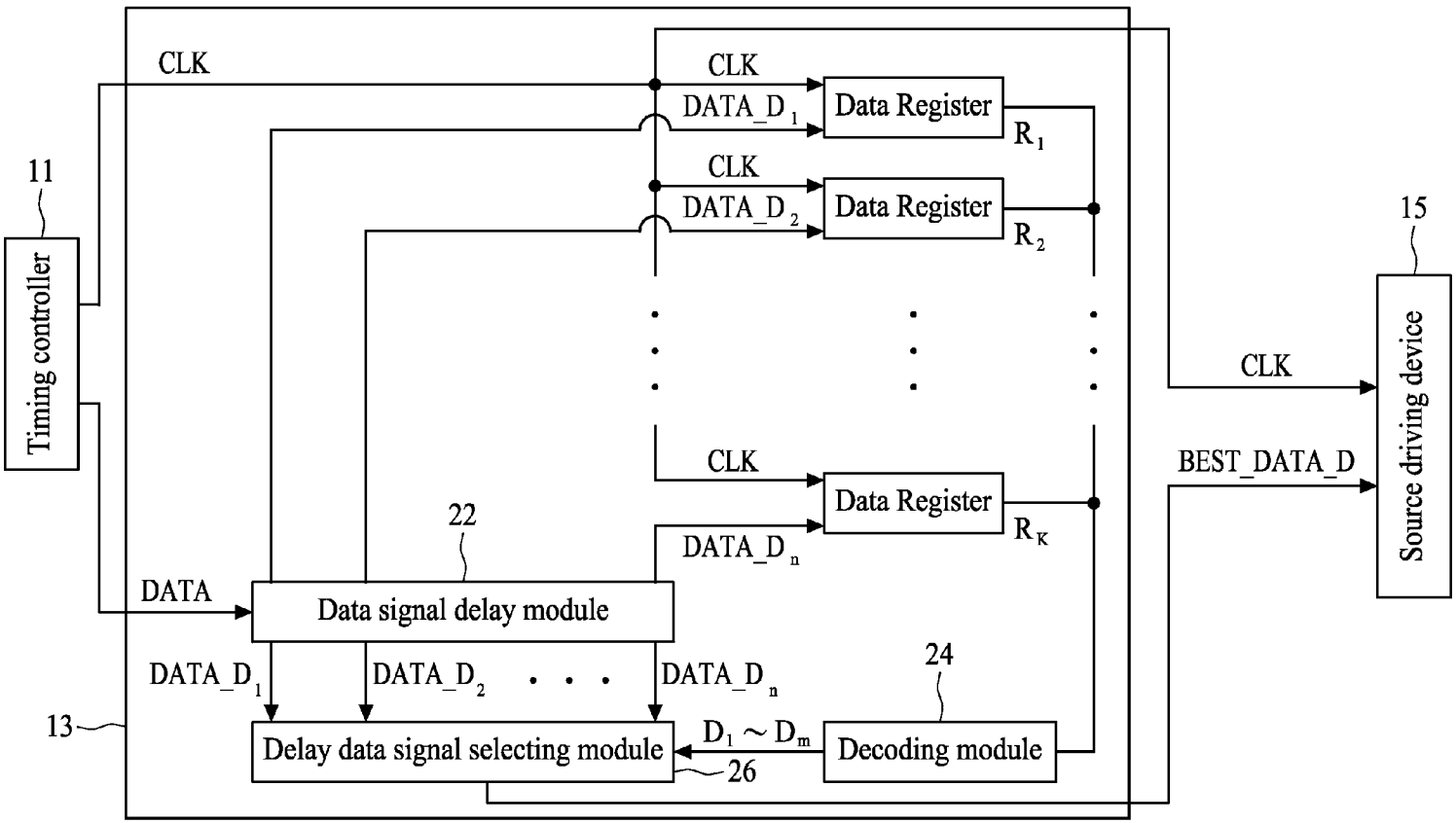
FIG. 2 shows a schematic view of one embodiment of the present invention showing a device with an automatic de-skew capability.

FIG. 2 shows a schematic view of one embodiment of the present invention showing a device with an automatic de-skew capability 13. The device with automatic de-skew capability 13 comprises a data signal delay module 22, a plurality of data register $R_1$ to $R_k$, a decoding module 24 and a delay data signal selecting module 26. The data signal delay module 22 is used for receiving the data signal (DATA), from the timing controller 11, and generates a plurality of data delay signals (DATA_$D_1$ to DATA_$D_n$), having different phases, to the clock signal receiving terminal of the plurality of data register $R_1$ to $R_k$. The data receiving terminals of the plurality of data registers $R_1$ to $R_k$ are used for receiving the clock signal (CLK). Meanwhile, the clock signal (CLK) may be transmitted to the source driving device 15.

The decoding module 24 is coupled to the plurality of data registers $R_1$ to $R_k$ and outputs a plurality of selecting signals $D_1$ to $D_k$ to the delay data signal selecting module 26. The data input terminal of the delay signal selecting module 26 is coupled to the data signal delay module 22 for receiving the plurality of data delay signals (DATA_$D_1$ to DATA_$D_n$), output from the data signal delay module 22.

In the registers $R_1$ to $R_k$, the data delay signals are used for sampling the clock signal. Moreover, a plurality of sampling results, $r_1$ to $r_k$, of a plurality of sampling signals are transmitted to the decoding module 24. A plurality of selecting signals $D_1$ to $D_m$ are generated by a decoding algorithm of the decoding module 24. The delay signal selecting module 26 may be a multiplexer. The best data delay signal (BEST_DATA_D), output from the delay signal selecting module 26, is transmitted to the source driving device 15.

Figure 3:
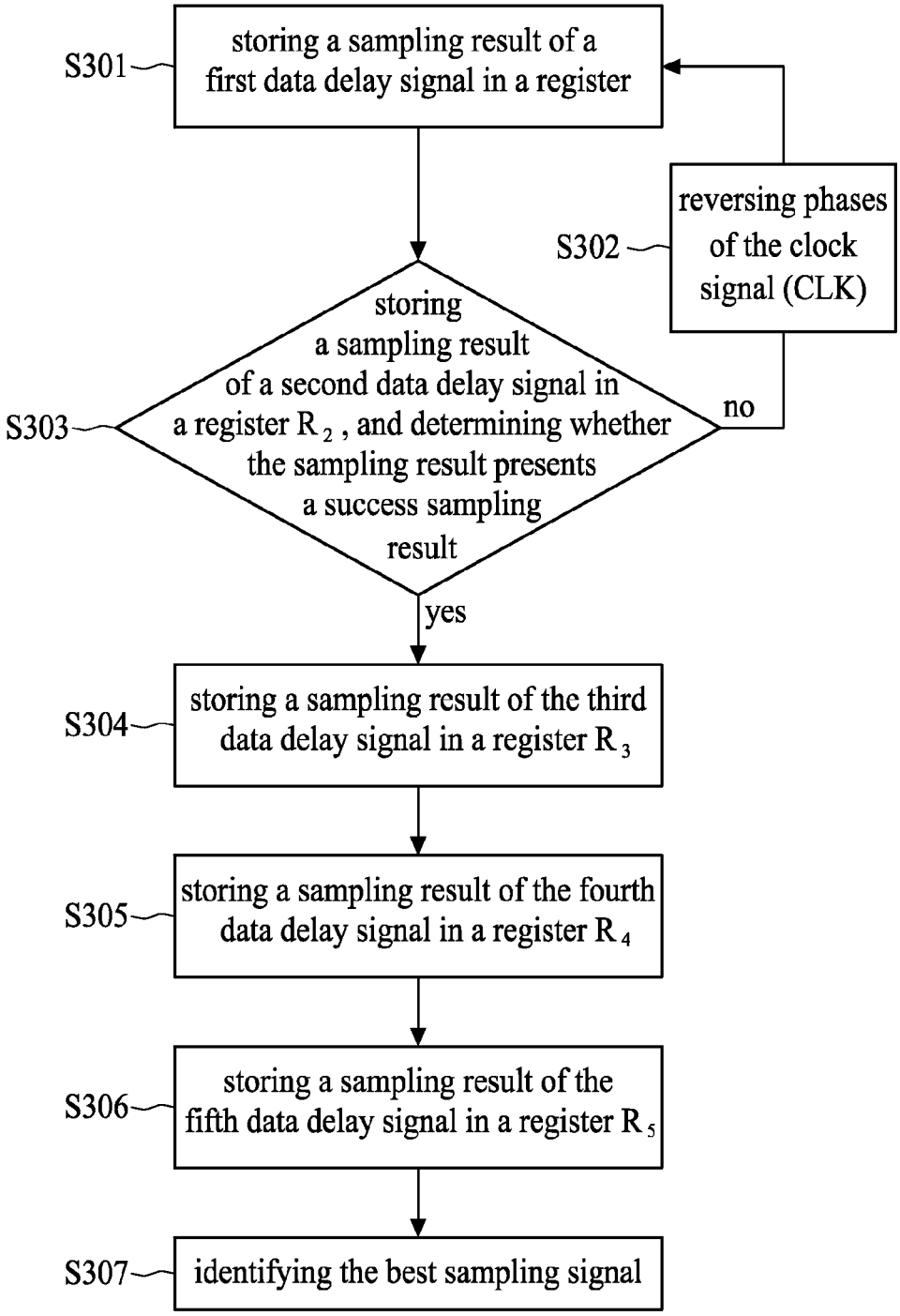
FIG. 3 shows a flow chart of one embodiment of the present invention illustrating binary search algorithm.

FIG. 3 shows a flow chart of one embodiment of the present invention illustrating binary search algorithms. The following utilizes a four bits delay to illustrate a method for selecting the best sampling signal. Step S301, a sampling result of a first data delay signal "1111" is stored in a register $R_1$. The sampling result, including a success sampling result or a failure sampling result, may be respectively presented with a bit, "1" or "0". Step S303, a sampling result of a second data delay signal "0111" is stored in a register $R_2$. If the sampling result of the second data delay signal "0111" presents "0" (a failure sampling result), step S302 may be performed and phases of the clock signal (CLK) may be reversed and step S301 may be performed again. If the sampling result of the second data delay signal "0111" presents "1" (a success sampling result), step S304 may be performed and a sampling result of the third data delay signal is stored in a register $R_3$. Then, step S305, a to sampling result of the fourth data delay signal is stored in a register $R_4$. Step S306, a sampling result of the fifth data delay signal is stored in a register $R_5$. Finally, step S307 may be performed for identifying the best sampling signal.

Figure 4:
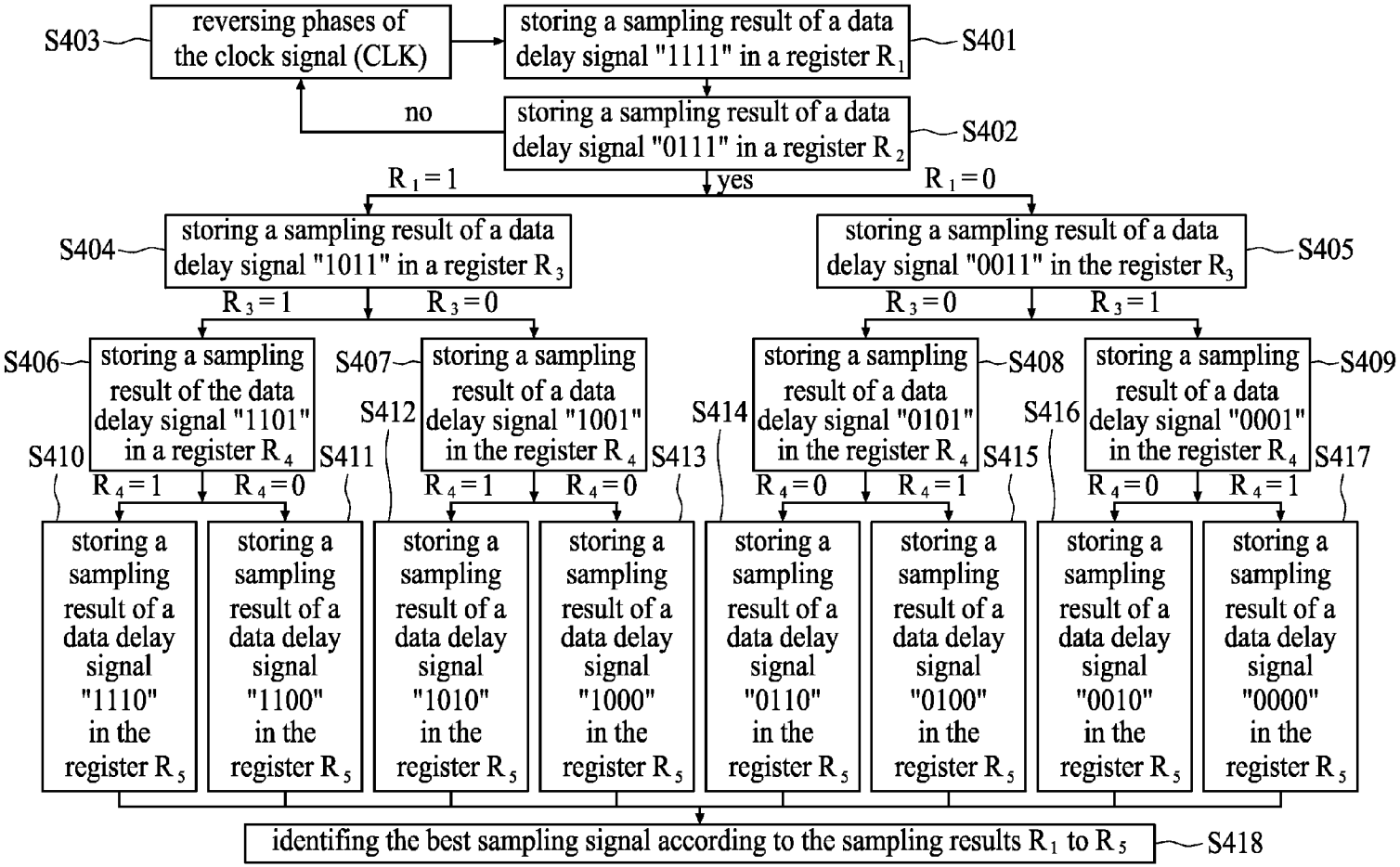
FIG. 4 shows a detailed flow chart of identifying the best sampling signal of FIG. 3.

FIG. 4 shows a detail flow chart of identifying the best sampling signal of FIG. 3. In step S401, a sampling result of a data delay signal "1111" is stored in a register $R_1$. In step S402, a sampling result of a data delay signal "0111" is stored in a register $R_2$. If the sampling result of the second data delay signal "0111" presents "0" (a failure sampling result), step S403 may be performed and phases of the clock signal (CLK) may be reversed and step S401 may be performed again. If both of the sampling result of the data delay signal "0111" and the sampling result of the data delay signal "1111" presents "1" (a success sampling result), step S404 may be performed and a sampling result of a data delay signal "1011" is stored in a register $R_3$. If the sampling result of the data delay signal "1011" presents "1", step S406 may be performed and a sampling result of the data delay signal "1101" is stored in a register $R_4$. If the sampling result of the data delay signal "1101" presents "1", step S410 may be performed and a sampling result of a data delay signal "1110" is stored in a register $R_5$. Finally, step S418, the best sampling signal may be identified according to sampling results $r_1$ to $r_5$.

While both of the sampling results stored in the register $R_1$ and in the register $R_2$ presents "1" but the sampling result stored in the register $R_3$ presents "0", step S407 may be performed and a sampling result of a data delay signal "1001" is stored in the register $R_4$. If the sampling result of the data delay signal "1001" presents "1", step S412 may be performed and a sampling result of the data delay signal "1010" is stored in the register $R_5$. If the sampling result of the data delay signal "1001" presents "0", step S413 may be performed and a sampling result of a data delay signal "1000" is stored in the register $R_5$. Finally, step S418, the best sampling signal may be is identified according to the sampling results $r_1$ to $r_5$.

As the sampling result stored in the register $R_2$ presents "1" and the sampling result stored in the register $R_1$ presents "0", step S405 may be performed and a sampling result of a data delay signal "0011" is stored in the register $R_3$. If the sampling result of the data delay signal "0011" presents "1", step S409 may be performed and a sampling result of a data delay signal "0001" is stored in the register $R_4$. If the sampling result of the data delay signal "0001" presents "1", step S417 may be performed and a sampling result of a data delay signal "0000" is stored in the register R. If the sampling result of the data delay signal "0001" presents "0", step S416 may be performed and a sampling result of a data delay signal "0010" is stored in a register $R_5$. Finally, step S418, the best sampling signal may be identified according to the sampling results $r_1$ to $r_5$.

As the sampling result stored in the register $R_2$ presents "1" the sampling result stored in the register $R_1$ presents "0" and the sampling result stored in the register $R_3$ presents "0", step S408 may be performed and a sampling result of a data delay signal "0101" is stored in the register $R_4$. If the sampling result of the data delay signal "0101" presents "1", step S415 may be performed and a sampling result of a data delay signal "0100" is stored in the register $R_5$. If the sampling result of the data delay signal "0101" presents "0", step S414 may be performed and a sampling result of a data delay signal "0110" is stored in the register $R_5$. Finally, step S418, the best sampling signal may be identified according to the sampling results $r_1$ to $r_5$.

Figure 5:
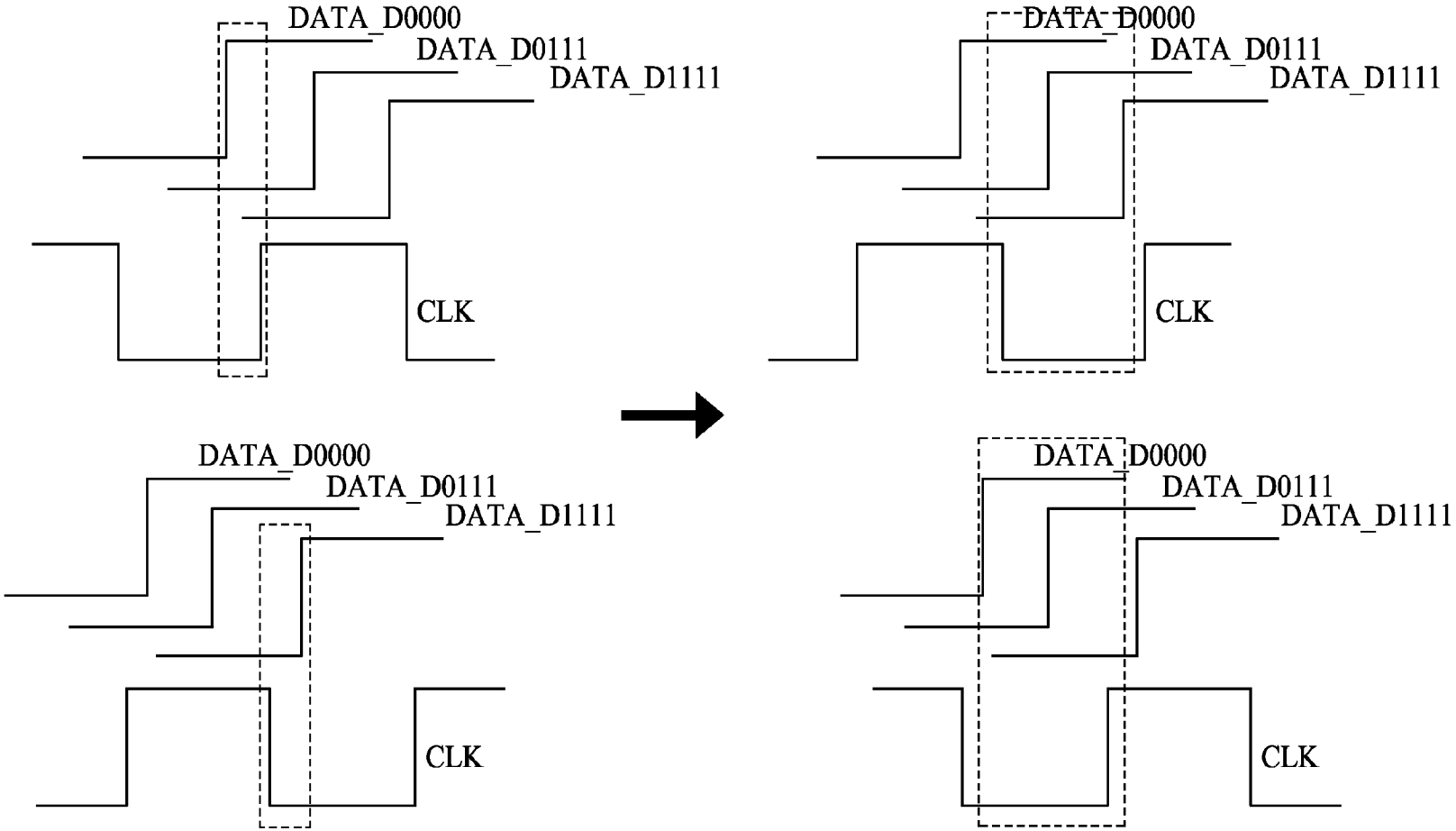
FIG. 5 shows sequence diagrams of the reversed clock signal.

FIG. 5 shows sequence diagrams of the reversed clock signal. While a sampling result stored in the register $R_2$ presents "0", and the rising edge of a data delay signal (DATA_$D_{0000}$) indicates to a point located within a data holding time of the clock signal (CLK), as shown in the upper left sequence diagram in FIG. 5, a sampling result of the data delay signal (DATA_$D_{0000}$) presents "1". However, a setup time may be shorter than the data holding time of the clock signal (CLK) at the same time. Therefore, the quantity of success sampling results may be fewer than 8, $2^4/2$, which is not enough for accurately identifying the best selecting signal.

Moreover, if the phases of the clock signal are reversed, as shown in the upper right sequence diagram in FIG. 5, the quantity of success sampling results may be more than 8, which is enough for accurately identifying the best selecting signal.

As shown in the bottom left sequence diagram in FIG. 5, the rising edge of a data delay signal (DATA_$D_{1111}$) indicates to a point located within a data holding time of the clock signal (CLK), and the resulting sample of the data delay signal (DATA_$D_{1111}$) presents "1". However, the data holding time of the clock signal (CLK) may be shorter than the setup time at the same time. Therefore, the quantity of success sampling results may be fewer than 8, which is not enough for accurately identifying the best selecting signal. Accordingly, if the phases of the clock signal (CLK) are reversed, as shown in the bottom right sequence diagram in FIG. 5, the quantity of success sampling results may be more than 8, which is enough for accurately identifying the best selecting signal.

FIG. 6 shows a true table of one embodiment of the present invention. The true table includes success sampling results and failure sampling results, which allows the data delay selecting module 26 to identify the best sampling signal from the true table. As shown in FIG. 6, a four bits phase delay may include sixteen different sampling results, and a selecting signal of the best sampling signal may be identified by the following logic calculations:

$$D4=\mathrm{XOR}(R5+R1),\ D3=\mathrm{XOR}(R4+R1),\ D2=\mathrm{XOR}(R3+R1)\ \text{and}\ D1=R1$$

Although the present invention and its objectives have been described in detail, it should be understood that various changes, substitutions and alterations can be made herein without departing from the spirit and scope of the invention as defined by the appended claims. For example, many of the processes discussed above can be implemented using different methodologies, replaced by other processes, or a combination thereof.

Moreover, the scope of the present application is not intended to be limited to the particular embodiments of the process, machine, manufacture, composition of matter, means, methods and steps described in the specification. As one of ordinary skill in the art will to readily appreciate from the disclosure of the present invention, processes, machines, manufacture, compositions of matter, means, methods, or steps, presently existing or later to be developed, that perform substantially the same function or achieve substantially the same result as the corresponding embodiments described herein may is be utilized according to the present invention. As such, the appended claims are intended to include within their scope such processes, machines, manufacture, compositions of matter, means, methods, or steps.

What is claimed is:

1. A device with an automatic de-skew capability, coupled between a source driving device and a timing controller, is used for receiving a data signal and a clock signal from the timing controller for driving a display panel, comprising:

a data signal delay module, which is used for receiving the data signal and generating a plurality of data delay signals, wherein each of the plurality of data delay signals has different phases;

a plurality of data registers, which has a clock signal receiving terminal, for receiving the clock signal, coupled to the data signal delay module, wherein the plurality of data delay signals are used for sampling the clock signal and wherein the plurality of data registers generates a logic value based on a sampling result;

a decoding module, which is coupled to an output terminal of the plurality of data registers used for generating a set of selecting signals; and a delay signal selecting module, which is coupled to an output terminal of the data signal delay module and outputs a best sampling signal, based on the set of selecting signals, to the source driving device, wherein the sampling result includes a success sampling result and a failure sampling result, wherein the decoding module calculates logic values of sampling results of the plurality of sampling signals, by a logic calculation, to generate a selecting signal corresponding to the best sampling signal, and the decoding module generates selecting signals $D_m$ and $D_1$ according to a formula ($D_m=\mathrm{XOR}(R_{m+1}+R_1)$, $D_1=R_1$), wherein "m" presents integer between 2 to the bit number of the data signal, "XOR" presents exclusive or operation, and "R" presents the value of a plurality of data registers.

2. The device with an automatic de-skew capability of claim 1, wherein the best sampling signal is a data delay signal, selected from the plurality of data delay signals, which has a rising edge indicating to a center point of a data holding time of the timing signal.

3. The device with an automatic de-skew capability of claim 1, wherein the success sampling result is defined as a rising edge of a data delay signal indicating to a point located within a data holding time of the clock signal and the failure sampling result is defined as a rising edge of a data delay signal failing to indicate to a point located within a data holding time of the clock signal, while the plurality of data delay signals samples the clock signal.

4. The device with an automatic de-skew capability of claim 1, wherein a judgment value of a maximum data delay signal is stored in a first register $R_{m+1}$, and a judgment value of a median data delay signal is stored in a second register $R_m$, if the second register is not able to sample successfully, phases of the clock signal need to be reversed.

5. The device with an automatic de-skew capability of claim 1, wherein the device utilizes a binary search to find a range of the best sampling signals.

* * * * *